US005167245A

United States Patent [19]

Harriett

[11] Patent Number: 5,167,245

[45] Date of Patent: Dec. 1, 1992

[54] HAIR TYING APPARATUS AND METHOD OF USE

[76] Inventor: Debra S. Harriett, 504 Grandview Av., Sanford, Fla. 32771

[21] Appl. No.: 829,483

[22] Filed: Feb. 3, 1992

[51] Int. Cl.[5] ..... A45D 8/34

[52] U.S. Cl. ..... 132/273; 132/200; 132/275

[58] Field of Search ..... 132/200, 201, 212, 273, 132/275; 2/174

[56] References Cited

U.S. PATENT DOCUMENTS

| | | | |
|---|---|---|---|
| 1,287,626 | 12/1918 | Brett | 132/273 |
| 1,424,654 | 8/1922 | Kitson | 132/273 |
| 1,892,262 | 12/1932 | Andrew | 132/273 |
| 2,560,095 | 7/1951 | Dolphin | 132/275 |
| 3,081,781 | 3/1963 | Stermer | 132/273 |
| 5,036,870 | 8/1991 | Edmark | 132/273 |
| 5,107,867 | 4/1992 | Barrington | 132/201 |

FOREIGN PATENT DOCUMENTS

| | | | |
|---|---|---|---|
| 21379 | 1/1901 | Switzerland | 132/273 |

*Primary Examiner*—Gene Mancene
*Assistant Examiner*—Frank A. LaViola
*Attorney, Agent, or Firm*—Paul S. Rooy

[57] ABSTRACT

A hair tying apparatus and method of use are disclosed. The apparatus comprises a needle with a shaft pointed at one end and having a head with an eye at the other, and a hair tie comprising at least one tie strand attached to an elastic loop. The method of use entails drawing the strand(s) through the elastic loop, thereby forming a hair tie loop, and subsequently through the eye of the needle, and then separating a top pony tail from the main pony tail of hair and drawing the top pony tail through the hair tie loop. The hair tie loop is then tightened around the base of the top pony tail, and the needle is used to draw the strand(s) around the top pony tail and a portion of the main pony tail along the length of the top pony tail, thereby holding the top pony tail in place relative to the main pony tail. Then the needle and strand(s) are wound around both the top pony tail and the main pony tail, thereby forming lower encircling loops, and the needle is used to draw the strand(s) through the approximate centers of the top pony tail and main pony tail. Finally, the remaining length of the strand(s) are either tucked under the lower encircling loops or, in the case of multiple strands, separated, wound around both the top pony tail and the main pony tail in opposite directions relative to each other, and tied using an appropriate knot such as a bow knot.

9 Claims, 6 Drawing Sheets 2
4
5
6
8
10
12
14
16
18
20
22
24

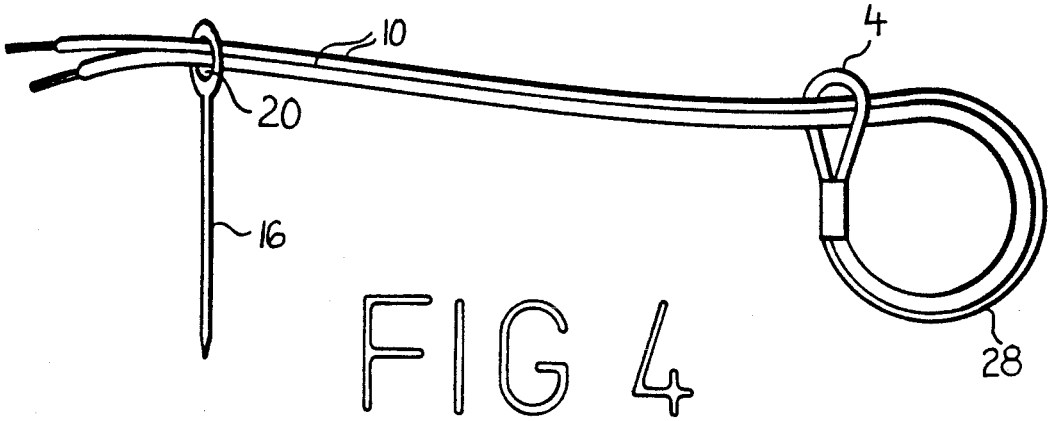
FIG 4
STEP 1
FIG 5
STEP 2
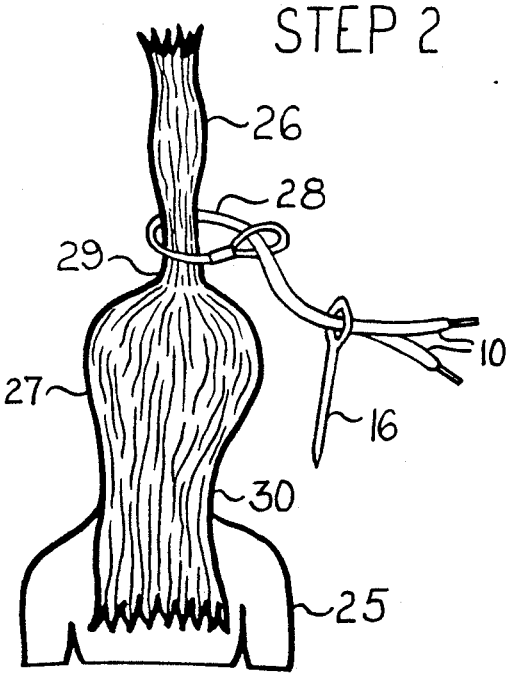
FIG 6
STEP 3
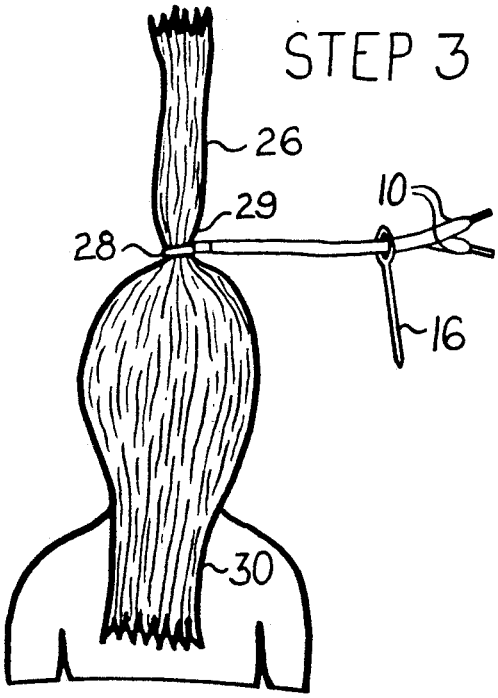

STEP 4

STEP 5

STEP 6

STEP 7

FIG 11
SECT. A-A
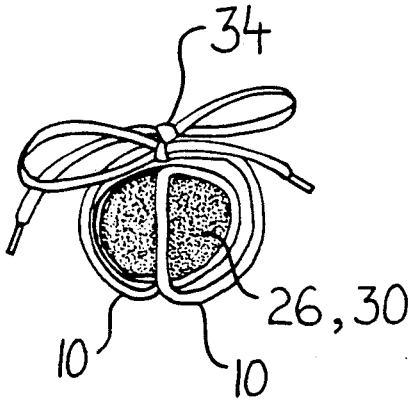
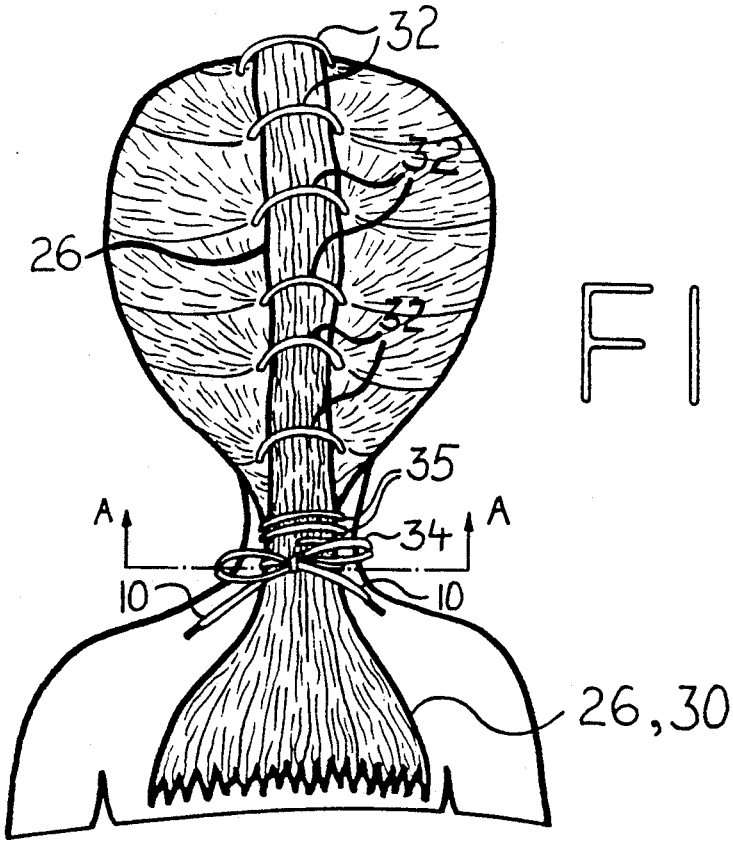
FIG 12
STEP 8

HAIR TYING APPARATUS AND METHOD OF USE

CROSS REFERENCE TO RELATED APPLICATIONS

| | | | |
|---|---|---|---|
| Swiss | 21378 | Nagelschmidt | |
| French | 587.370 | Omnes | |
| | 5.036.870 | Edmark | Hair Styling Tool |
| | 2.924.228 | McGee | Ladies' Hair Clasp Device |

BACKGROUND OF THE INVENTION

1. Field of the Invention

The present invention relates to hair tying devices and methods, and in particular to a hair tying device and method for producing an ornate, braided appearance easily and quickly.

2. Background of the Invention

The art of hair tying and control is important not only from an aesthetic point of view but also from a practical standpoint. The control of long hair is essential to prevent loss of vision due to hair blowing in one's face or hair getting caught in one's surroundings. The manner of hair control may also be attractive in appearance depending on the method of controlling the hair.

A popular method of hair control involves tying the hair back away from the field of vision. Tying hair back in an ornate and pleasing fashion currently requires considerable expenditure of time and effort. Various tools and methods have been invented to facilitate this task.

DESCRIPTION OF THE PRIOR ART

Swiss patent No. 21379 was granted Nagelschmidt for a lasso shaped hair tie which could encircle a pony tail and secure the pony tail in place by wrapping the tie about itself, thus avoiding the necessity of tying a knot.

Omnes was granted French patent No. 587,370 for a hair tie having hooks at each end. This tie was capable of encircling a pony tail and holding itself in place by engaging the hooks with the pony tail hair.

While both the Swiss patent '379 and the French patent '370 teach simplified ways to secure hair into a pony tail, neither method produces an ornate, braided appearance.

Edmark received U.S. Pat. No. 5,036,870 for a hair tying tool capable of producing a one knot braided pony tail. While looking more ornate than the simple ties taught by the Swiss patent '379 and the French patent '370, Edmark's device still does not produce the finished appearance of a full braid.

U.S. Pat. No. 2,924,228 was granted McGee for a Ladies' Hair Clasp Device. This clasp was spiral shaped and could be wound around a pony tail, thus holding the pony tail in place. While simple to use, McGee's device did not produce an ornate appearance.

SUMMARY OF THE INVENTION

Accordingly, it is an object of this invention to provide a hair tying apparatus and method of use capable of being easily and quickly used to control hair.

It is another object of this invention to provide a hair tying apparatus and method of use which produces an ornate braided appearance when used in the control of hair.

It is still another object of this invention to provide a hair tying apparatus and method of use which is economical to produce so as to be easily affordable.

It is another object of this invention to provide a hair tying apparatus and method of use which is constructed of materials which are attractive when used in the control of hair.

It is still another object of this invention to provide a hair tying apparatus and method of use which is easy to learn and implement, thereby rendering the method of use easily practiced by the average consumer.

BRIEF DESCRIPTION OF THE DRAWINGS

The invention, together with the other objects, features, aspects and advantages thereof will be more clearly understood from the following in conjunction with the accompanying drawings.

Six sheets of drawings are provided. Sheet one contains FIGS. 1, 2 and 3, sheet two contains figures 4, 5 and 6, sheet three contains FIGS. 7 and 8, sheet four contains FIGS. 9 and 10, sheet five contains FIGS. 11 and 12, and sheet six contains FIGS. 13 and 14.

FIG. 4 is a front isometric view of a hair tie loop engaged with a needle, ready to be used to tie hair. FIG. 4 shows Step 1 of the instant hair tying method.

FIG. 5 shows Step 2 of the instant hair tying method.

FIG. 6 depicts Step 3 of the instant hair tying method.

FIG. 11 is a sectional view of the hair tie taken at section A—A of FIG. 12.

FIG. 12 shows Step 8 of the instant hair tying method.

COMPLETE DESCRIPTION OF THE PREFERRED EMBODIMENT

Figures 1, 2, 3:
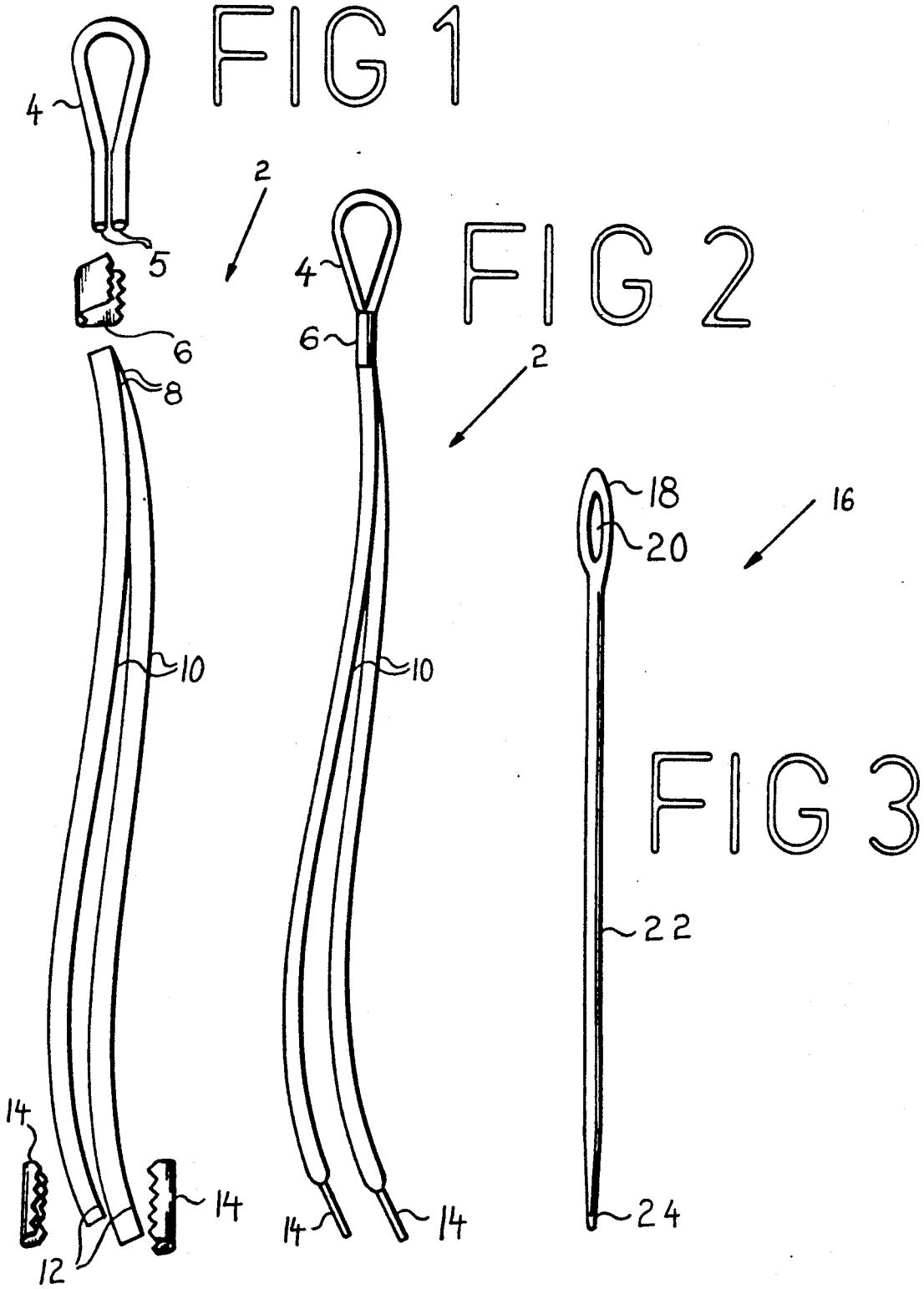
FIG. 1 is a front isometric view of a disassembled hair tie.
FIG. 2 is a front isometric view of an assembled hair tie.
FIG. 3 is a front isometric view of a needle.

Referring now to FIG. 1 we can observe a hair tie 2 in a disassembled condition. Elastic loop 4 has elastic loop ends 5. Elastic loop 4 may be made of stretch cloth covering elastic such as is commonly used in sewing applications, or other appropriate elastic material, and may be brightly colored and/or patterned. We can see loop clamp 6, which may be made of crimpable metal or other appropriate material.

Tie strands 10 have tie strand upper ends 8 and tie strand lower ends 12. Tie strands 10 may be made of cloth material similar to that used for shoe laces or other appropriate material and may be brightly colored and/or patterned.

Tie strand end clamps 14 may be made of crimpable metal or similar material.

FIG. 2 depicts an assembled hair tie 2. Loop clamp 6 has been crimped around elastic loop ends 5 and tie strand upper ends 8, thereby attaching elastic loop 4 to tie strands 10. Tie strand end clamps 14 have been crimped around tie strand lower ends 12.

Figure 13:
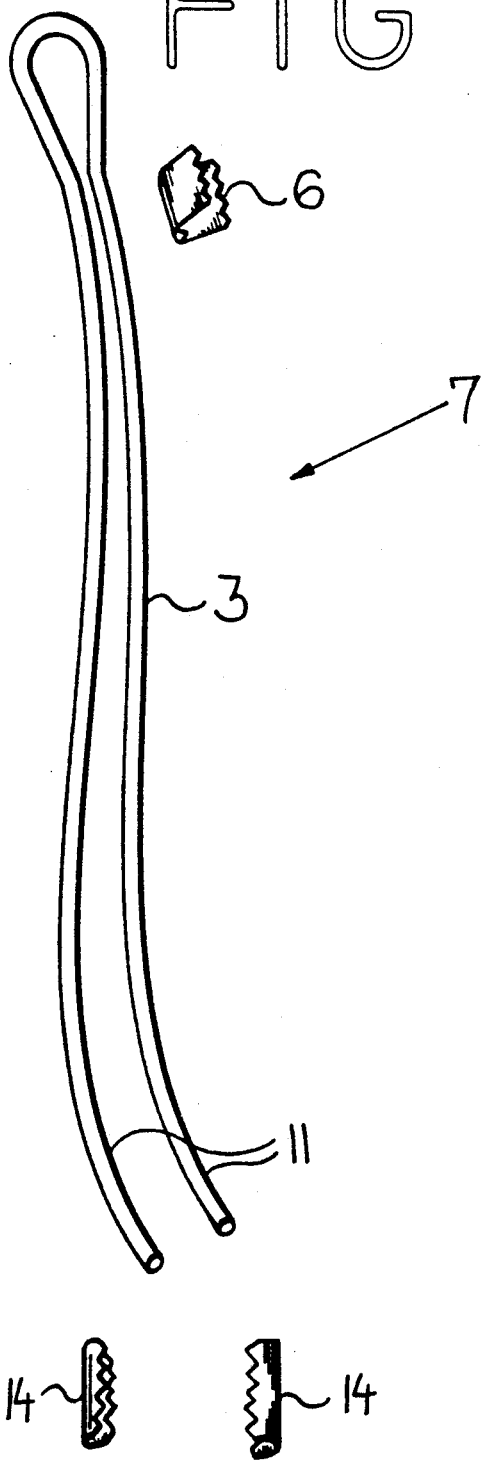
FIG. 13 is a front isometric view of a disassembled elastic hair tie.
Figure 14:
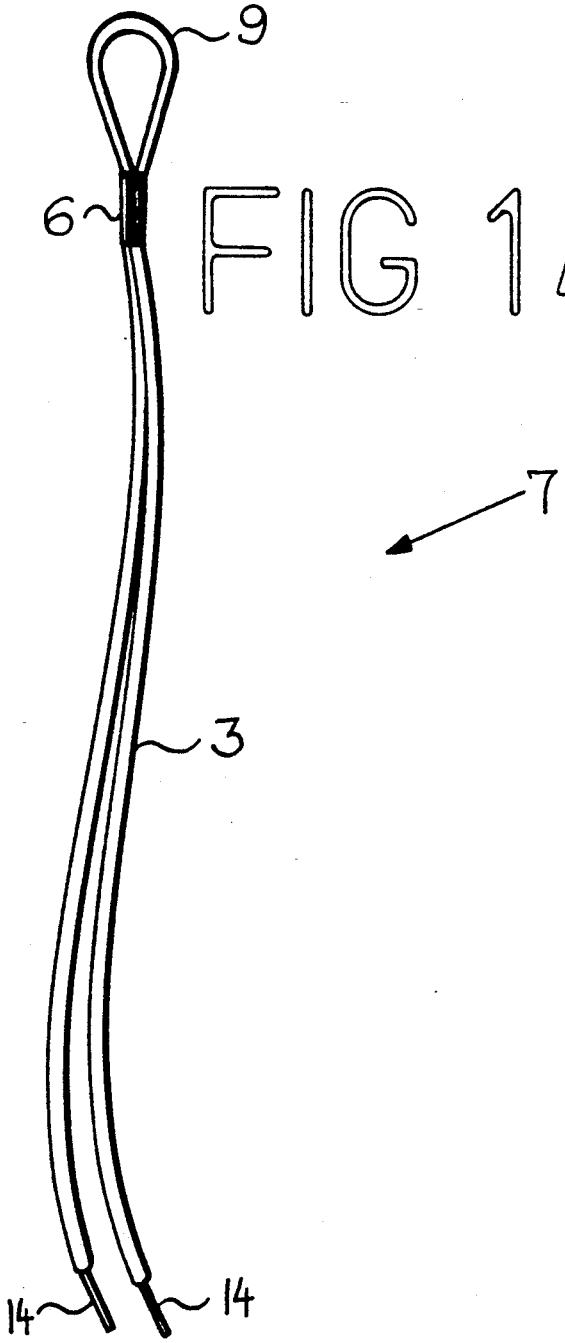
FIG. 14 is a front isometric view of an assembled elastic hair tie.

Referring to FIGS. 13 and 14 we can observe an alternate embodiment of hair tie 2, namely elastic hair tie 7. FIG. 13 shows an elastic hair tie 7 disassembled: we have elastic strand 3 having elastic strand ends 11, loop clamp 6 and tie strand end clamps 14. Elastic strand 3 may be made of stretch cloth covering elastic such as is commonly used in sewing applications, or other appropriate elastic material, and may be brightly colored and/or patterned.

FIG. 14 shows elastic hair tie 7 in an assembled condition. Loop clamp 6 has been crimped around elastic strand 3 to form elastic strand loop 9. Tie strand end clamps 14 have been crimped around elastic strand ends 11.

FIG. 3 is a front isometric view of needle 16. At one end of shaft 22 we can see point 24 and at the opposite end we can observe head 18 containing eye 20. Eye 20 is sized so as to allow tie strands 10 to be drawn through it. Needle 16 may be made of plastic, nylon, metal or other appropriate material.

FIG. 4 shows the first step of the instant hair tying method. Tie strands 10 have been drawn through elastic loop 4, thereby creating hair tie loop 28. Tie stands 10 have subsequently been drawn through eye 20 of needle 16.

FIGS. 5–10 and 12 are a rear views of person 25 having hair 27 on head 31.

FIG. 5 depicts Step 2 of the instant hair tying method. Top pony tail 26 having top pony tail base 29 has been separated from main pony tail 30. Top pony tail 26 is then drawn through hair tie loop 28.

An alternate procedure for Steps 1 and 2 would be to pass elastic loop 4 around top pony tail 26, thread tie strands 10 through eye 20 of needle 16 and then draw needle 16 and strands 10 through elastic loop 4, thereby yielding the condition shown in FIG. 5.

FIG. 6 shows Step 3 of the instant hair tying method. Hair tie loop 28 has been tightened around top pony tail base 29. Due to the elastic nature of elastic loop 4, tightened hair tie loop 28 tends to grip top pony tail base 29, thereby maintaining the position of tightened hair tie loop 28 on top pony tail 26.

Figure 7:
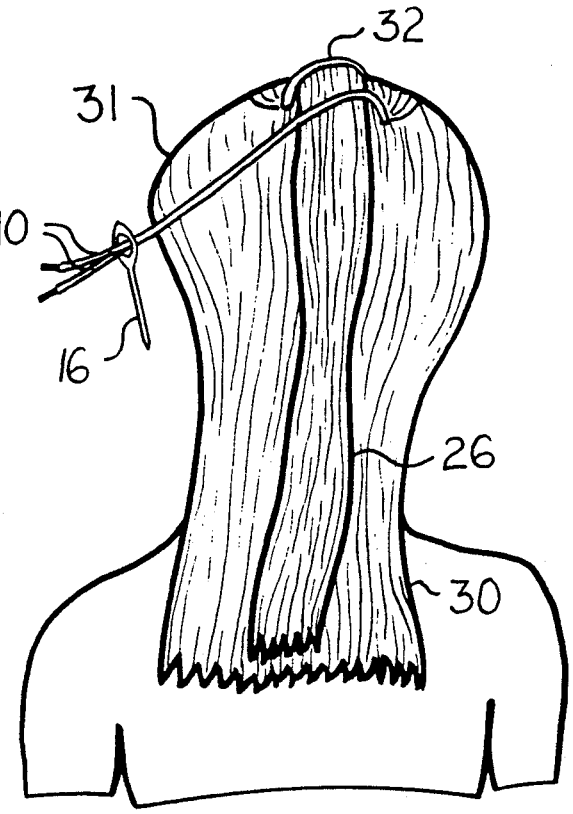
FIG. 7 illustrates Step 4 of the instant hair tying method.

FIG. 7 depicts Step 4 of the instant hair tying method. Needle 16 has been used to draw tie strands 10 around top pony tail 26 and a portion of main pony tail 30, thereby drawing hair 27 from main pony tail 30 sideways towards the rear of head 31 into top pony tail 26 and creating encircling loops 32. Encircling loops 32 hold top pony tail 26 in place relative to main pony tail 30 and provide for an ornate "French Braid" appearance.

Figure 8:
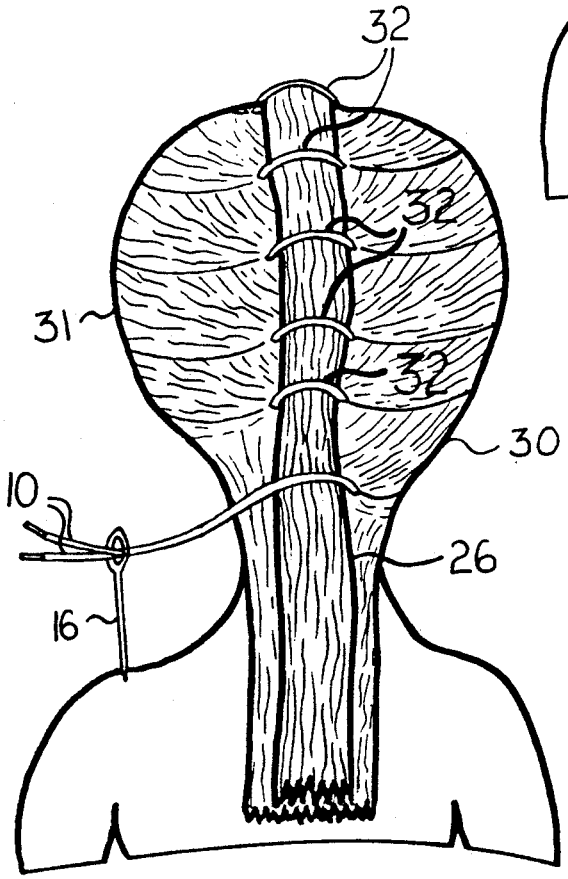
FIG. 8 shows Step 5 of the instant hair tying method.

FIG. 8 illustrates Step 5 of the instant hair tying method. Needle 16 has been used to draw tie strands 10 around top pony tail 26 and a portion of main pony tail 30, thereby forming encircling loops 32 along the length of top pony tail 26. Encircling loops 32 hold the upper part of top pony tail 26 in place relative to main pony tail 30 and draw hair 27 sideways from main pony tail 30 towards the rear of head 31 into top pony tail 26, thereby providing for an ornate "French Braid" appearance.

The process shown in FIGS. 7 and 8 (Steps 4 and 5) may be described as "sewing" the hair 27 from main pony tail 30 sideways towards the rear of head 31 into top pony tail 26.

Figure 9:
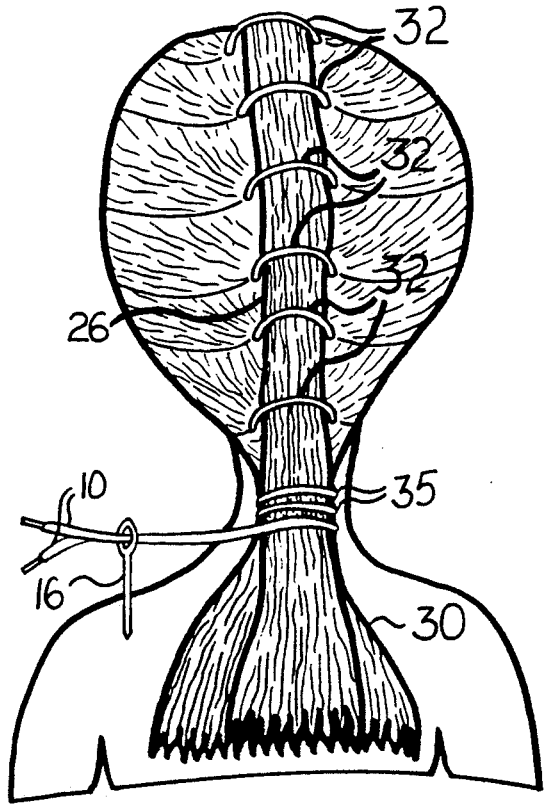
FIG. 9 depicts Step 6 of the instant hair tying method.

FIG. 9 shows Step 6 of the instant hair tying method. Needle 16 and stands 10 have been wound around both top pony tail 26 and main pony tail 30, thereby forming several lower encircling loops 35.

Figure 10:
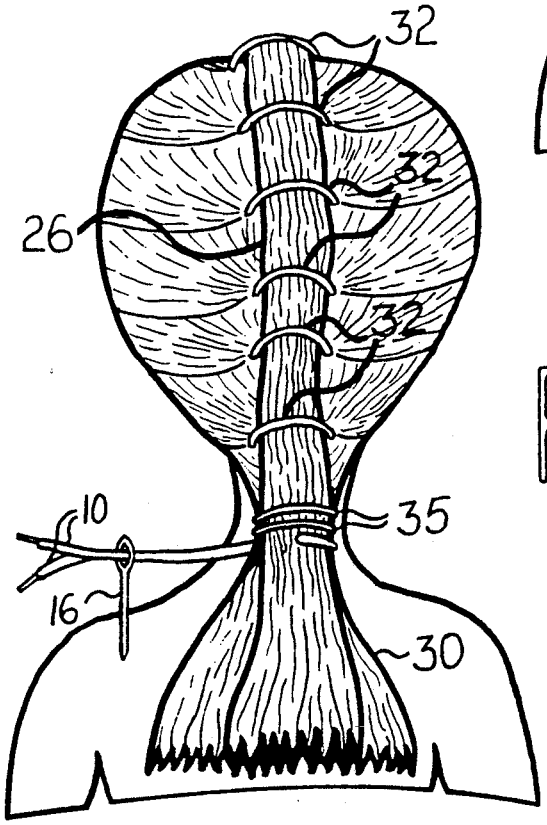
FIG. 10 illustrates Step 7 of the instant hair tying method.

FIG. 10 depicts Step 7 of the instant hair tying method. Needle 16 has been used to draw strands 10 through the approximate center of top pony tail 26 and main pony tail 30.

FIG. 12 depicts Step 8 of the instant hair tying method. After having been drawn through top pony tail 26 and main pony tail 30 as described above in Step 7 of the instant hair tying method, tie strands 10 have been separated from each other and wound around both top pony tail 26 and main pony tail 30 in opposite directions relative to each other. Tie strands 10 are then tied together using a suitable knot such as bow knot 34.

FIG. 11 is a cross sectional view taken at section A—A of FIG. 12. We can see tie strands 10 separated after passing through top pony tail 26 and main pony tail 30. Strands 10 are then wound around both top pony tail 26 and main pony tail 30 in opposite directions relative to each other, and then tied together using a suitable knot such as bow knot 34.

An alternate to step 8 of the instant hair tying method would be to tuck the remaining length of tie strands 10 into lower encircling loops 35.

While a preferred embodiment of the invention has been illustrated herein, it is to be understood that changes and variations may be made by those skilled in the art without departing from the spirit and scope of the appending claims.

I claim:

1. A hair tying apparatus comprising:

a needle having a shaft with one pointed end and an opposite end having a head with an eye, and a hair tie comprising:

at least one tie strand sized to be drawn removably through the eye of said needle, each of said at least one tie strand having a tie strand upper end at one end and at the opposite end a tie strand lower end an elastic loop having two elastic loop ends, and means of attaching each of said upper tie strand ends to said elastic loop ends.

2. The hair tying apparatus of claim 1 wherein the means of attaching each of said tie strand upper ends to said elastic loop ends comprises a loop clamp.

3. The hair tying apparatus of claim 2 wherein a tie strand end clamp is crimped around each of said tie strand lower ends.

4. The hair tying apparatus of claim 3 wherein the said hair tie has two said strands.

5. A hair tying apparatus comprising:

a needle having a shaft with one pointed end and an opposite end having a head with an eye, and an elastic hair tie comprising:

a stretchable elastic strand having two elastic strand ends, and a loop clamp crimped around said elastic strand such that an elastic strand loop emerges from one end of said loop clamp and the remaining length of said elastic strand terminating in said elastic strand ends emerges from the other end of said loop clamp.

6. The hair tying apparatus of claim 5 further comprising a tie strand end clamp crimped around each of said elastic strand ends.

7. A method of hair tying using a hair tying apparatus, said hair tying apparatus comprising:

a needle having a shaft with one pointed end and an opposite end having a head with an eye, and a hair tie comprising:

at least one tie strand sized to be drawn removably through the eye of said needle, each of said at least one tie strand having a tie strand upper end at one end and at the opposite end a tie strand lower end, an elastic loop having two elastic loop ends, and means of attaching said upper tie strand ends to said elastic loop ends, said method of tying hair comprising the following steps;

Step A: draw the said at least one tie strand through the said elastic loop, thereby forming a hair tie loop, and subsequently draw said at least one tie strand through the eye of said needle, Step B: separate a top pony tail having a top pony tail upper part and a top pony tail base from a main pony tail o hair and draw said top pony tail through said hair tie loop, Step C: tighten said hair tie loop around said top pony tail base, Step D: use said needle to draw said at least one tie strand around said top pony tail and a portion of said main pony tail, thereby forming encircling loops, Step E: continue using said needle to draw said at least one tie strand around said top pony tail and a portion of said main pony tail, thereby forming encircling loops around said top pony tail upper part and a portion of said main pony tail which hold said top pony tail in place relative to said main pony tail, Step F: wind said needle and said at least one tie strand around said top pony tail and said main pony tail, thereby forming lower encircling loops, Step G: use said needle to draw said at least one tie strand through said top pony tail and said main pony tail, and Step H: tuck the remaining length of said at least one tie strand under said lower encircling loops.

8. The method of hair tying of claim 7 wherein Steps A and B comprise:

Step A: separate a top pony tail having a top pony tail base from the main pony tail of hair and draw said elastic loop Step B: draw said at least one tie strand through the eye of said needle and then draw said needle and said at least one tie strands through said elastic loop.

9. The method of hair tying of claim 7 wherein Step H comprises:

Step H: after using said needle to draw said tie strands through the approximate centers of said top pony tail and said main pony tail as described in Step G above, separate said tie strands from each other and wind them around both said top pony tail and said main pony tail in opposite directions relative to each other, and then tie said tie strands together using a suitable knot.

* * * * *

UNITED STATES PATENT AND TRADEMARK OFFICE

CERTIFICATE OF CORRECTION

PATENT NO. : 5,167,245

DATED : 12/1/1992

INVENTOR(S) : Debra S. Harriett

It is certified that error appears in the above-identified patent and that said Letters Patent is hereby corrected as shown below:

Column 5, Line 20: "o" should be "of".

Column 6, Line 16: Add "around it, and" after "elastic loop".

Column 6, Line 23: Add "applicable when said hair tie comprises two or more tie strands" after "Step H".

Signed and Sealed this

Twenty-ninth Day of March, 1994

*Attest:*

Bruce Lehman

BRUCE LEHMAN

*Attesting Officer*

*Commissioner of Patents and Trademarks*